US011833097B2

(12) United States Patent
Rayman

(10) Patent No.: US 11,833,097 B2
(45) Date of Patent: Dec. 5, 2023

(54) APPARATUS FOR TONING A PERSON'S BUTTOCKS

(71) Applicant: Sculpted Partners LLC, New York, NY (US)

(72) Inventor: Erika Rayman, New York, NY (US)

(73) Assignee: Sculpted Partners LLC, New York, NY (US)

( * ) Notice: Subject to any disclaimer, the term of this patent is extended or adjusted under 35 U.S.C. 154(b) by 623 days.

(21) Appl. No.: 16/875,007

(22) Filed: May 15, 2020

(65) Prior Publication Data

US 2021/0353490 A1 Nov. 18, 2021

(51) Int. Cl.

| | |
|---|---|
| ***A61H 1/00*** | (2006.01) |
| ***A63B 21/00*** | (2006.01) |
| ***A63B 23/04*** | (2006.01) |

(52) U.S. Cl.

CPC ..... *A61H 1/005* (2013.01); *A63B 21/00* (2013.01); *A63B 21/00181* (2013.01); *A61H 2201/0149* (2013.01); *A61H 2201/14* (2013.01); *A61H 2201/1635* (2013.01); *A61H 2201/1657* (2013.01); *A61H 2203/0425* (2013.01); *A61H 2205/086* (2013.01); *A63B 2023/0411* (2013.01)

(58) Field of Classification Search

CPC ..... A63B 21/0428; A63B 21/023; A63B 21/4031; A63B 21/068; A61H 1/00; A61H 1/005; A61H 1/008; A61H 1/0229; A61H 1/0292; A61H 2201/0134; A61H 2201/0192; A61H 2201/1669; A61H 2201/1671; A61H 2201/5064; A61H 2203/0456; A61H 2203/0468; A61H 2203/0475; A61H 2205/081

USPC ..... 482/94; 601/15–18

See application file for complete search history.

(56) References Cited

U.S. PATENT DOCUMENTS

| | | | | |
|---|---|---|---|---|
| 2,201,036 A | | 5/1940 | Guerrier | |
| 3,619,820 A | * | 11/1971 | Cain et al. | A47K 17/026 4/237 |
| 4,125,242 A | * | 11/1978 | Meiller | B60N 2/544 248/525 |
| 4,618,140 A | | 10/1986 | Brown | |
| 4,894,871 A | * | 1/1990 | Schmerler | A47K 17/026 135/67 |
| 5,007,618 A | * | 4/1991 | Libby | A47K 17/026 135/65 |
| 5,201,694 A | * | 4/1993 | Zappel | A63B 23/0405 482/133 |
| 5,398,375 A | * | 3/1995 | Niederquell | A47C 9/00 16/429 |
| 5,498,064 A | * | 3/1996 | Hooker | A61G 7/1007 297/DIG. 10 |

(Continued)

*Primary Examiner* — Justine R Yu
*Assistant Examiner* — Alexander Morales
(74) *Attorney, Agent, or Firm* — LADAS & PARRY LLP

(57) ABSTRACT

An apparatus for toning an exerciser's buttocks comprises, a base having a front end region and a rear end region; a seat guide; and a force-transmitting mechanism for supporting the seat guide on the base for guided movement under tension from a raised position, along an forward inclined trajectory in which the seat guide is continuously lowered in elevation to a lowered position. The exerciser sits on the seat guide and controls its downward and upward motion by tensioning and thereby exercising the users gluteus maximus, medius, and gluteus minimus muscles.

8 Claims, 6 Drawing Sheets

(56) References Cited

U.S. PATENT DOCUMENTS

| | | | | |
|---|---|---|---|---|
| 5,643,147 | A | 7/1997 | Huang | |
| 6,676,573 | B2 * | 1/2004 | Abelbeck | A63B 21/4047 482/121 |
| 7,247,128 | B2 | 7/2007 | Oga | |
| 7,452,311 | B2 | 11/2008 | Barnes et al. | |
| 8,967,642 | B2 * | 3/2015 | Bagheri | A61H 3/008 280/87.041 |
| 9,375,607 | B1 | 6/2016 | Rayman et al. | |
| 9,717,942 | B2 * | 8/2017 | Bastyr | A63B 23/0355 |
| 10,118,070 | B2 * | 11/2018 | Lin | A63B 21/4033 |
| 10,569,130 | B2 * | 2/2020 | Ku | A63B 23/0405 482/140 |
| 10,870,046 | B2 * | 12/2020 | Franklin | A63B 21/4047 482/121 |
| 11,123,245 | B2 * | 9/2021 | Yeh | A63B 23/0405 482/133 |
| 2008/0064577 | A1 * | 3/2008 | Pederson | A63B 23/0405 482/140 |
| 2012/0058866 | A1 | 3/2012 | Hongo et al. | |
| 2013/0324374 | A1 | 12/2013 | Ellis | |

* cited by examiner

APPARATUS FOR TONING A PERSON'S BUTTOCKS

FIELD OF THE DISCLOSURE

This disclosure generally relates to an exercising apparatus, and, more particularly, to an apparatus for toning and firming a person's buttocks by targeting and strengthening the person's gluteal muscles.

BACKGROUND

Many different types of exercising apparatus have been proposed for the purpose of strengthening a person's muscles. However, few, if any, apparatus have been designed solely for the purpose of toning and firming a person's buttocks, which, with today's sedentary life style, are apt to become flabby and unfirm. Saggy buttocks can also be caused by extreme weight loss, aging, or genetics. The buttocks are, of course, the two rounded portions of a person's anatomy at the posterior of the pelvic region and comprise a layer of fat superimposed on the gluteal muscles, commonly known as glutes, which comprise the gluteus maximus muscle, the gluteus medius muscle, and the gluteus minimus muscle. Toned, firm buttocks can not only boost one's body image, but also can help maintain a person's trunk in an erect posture.

The lack or scarcity of such toning apparatus has led many people to resort to cosmetic surgical procedures, commonly known as buttock lifts, to improve the appearance of their buttocks. However, such procedures are costly and may involve a lengthy recovery period since they typically require removing excess skin and fat from the buttocks, followed by repositioning the remaining skin. As a result, many people who could benefit from such procedures may forego them.

Accordingly, there is a need to tone, firm, tighten and sculpt a person's buttocks without resorting to surgical procedures, preferably by using specially designed apparatus that targets and strengthens the gluteal muscles, especially in the privacy of one's home, or in a gym.

BRIEF DESCRIPTION OF THE INVENTION

The current invention relates to an apparatus for toning an exerciser's buttocks. The apparatus includes a base having a front end region and a rear end region, a seat guide, and a force-transmitting mechanism. The mechanism supports the seat guide on the base for guided movement under tension from a raised position in which the seat guide is situated at a first higher elevation above the rear end region of the base, along an inclined trajectory in which the seat guide is continuously lowered in elevation and continuously moved toward the front end region of the base, to a second lowered position in which the seat guide is situated at a lower elevation above the base. The seat guide is biased in the upper position.

The user sits on the seat guide, and with a controlled motion allows the seat guide to slowly descend to the lowered position. From there the user allows the seat guide to rise back to the initial raised position. Control over the speed of descent and ascent is through the user tensioning the glutes, thereby exercising them through a repetitive lowering and raising of the seat guide and thus the user's body.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
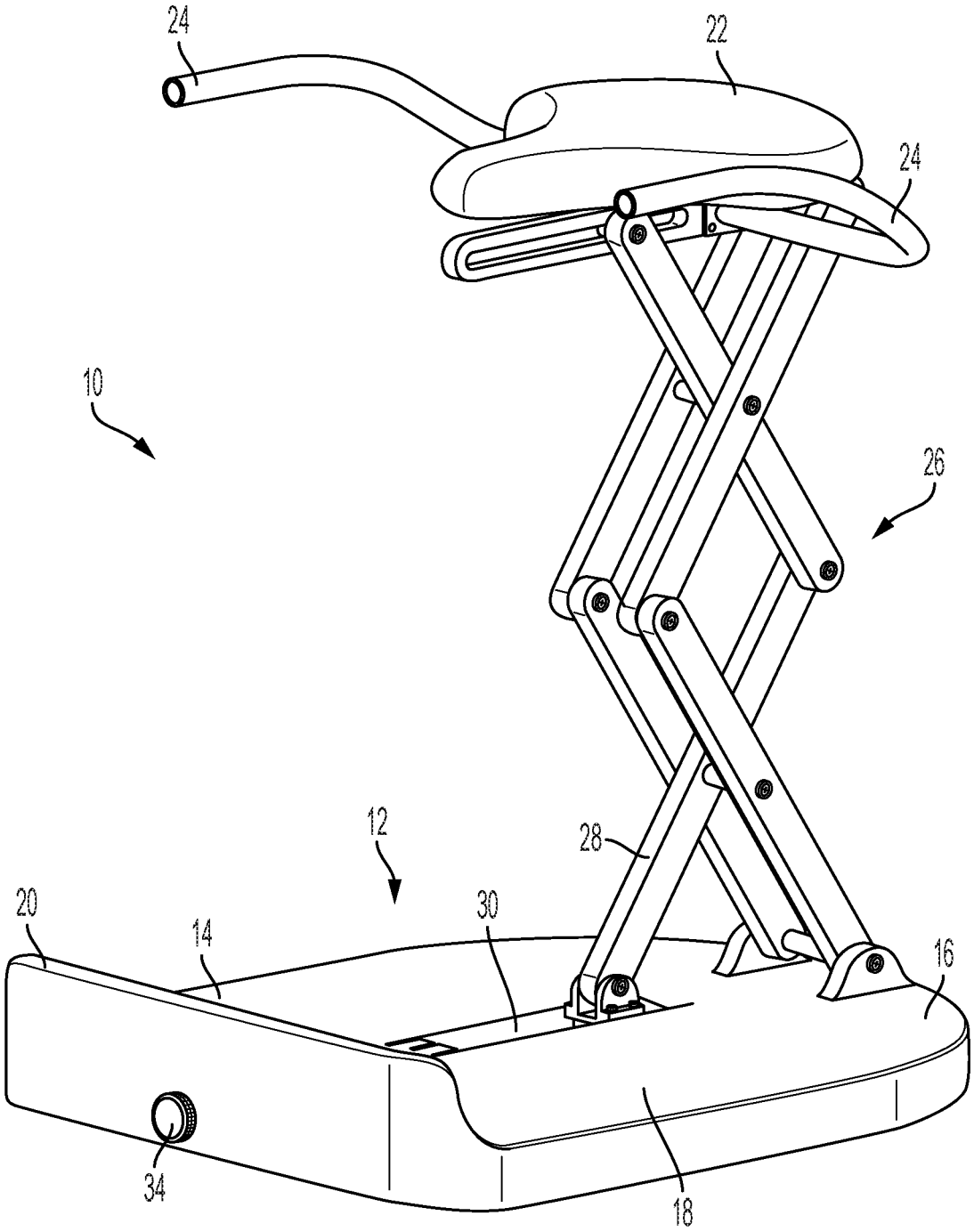
FIG. 1 is a perspective view of an apparatus for toning a person's buttocks in a raised position in accordance with the present disclosure.
Figure 2:
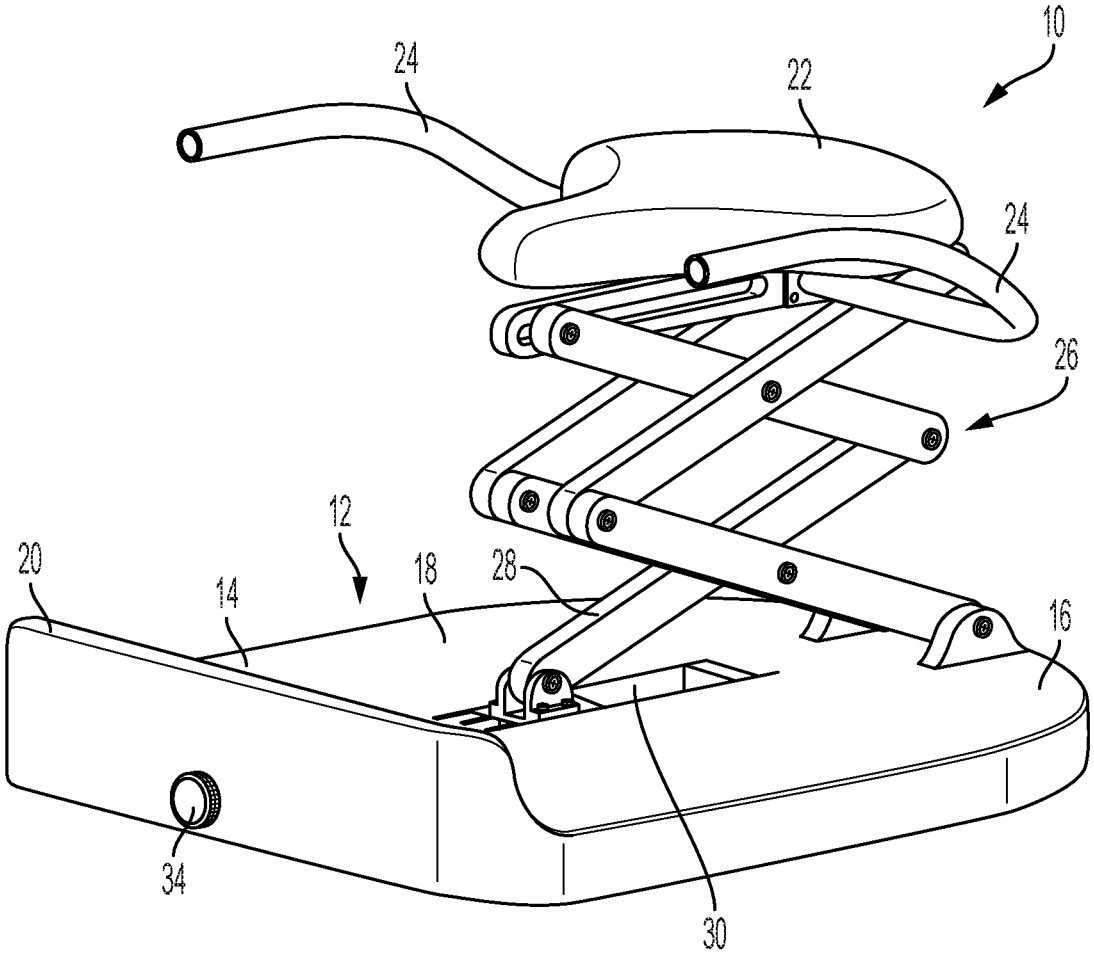
FIG. 2 is a perspective view of the apparatus of FIG. 1 in a lowered position.

Skilled artisans and practitioners will appreciate that elements in the figures are illustrated for simplicity and clarity and have not necessarily been drawn to scale. For example, the dimensions and locations of some of the elements in the figures may be exaggerated relative to other elements to help to improve understanding of embodiments of the present invention.

The apparatus components have been represented where appropriate by conventional symbols in the drawings, showing only those specific details that are pertinent: to understanding the embodiments of the present invention so as not to obscure the disclosure with details that will be readily apparent to those of ordinary skill in the art having the benefit of the description herein.

DETAILED DESCRIPTION

In a preferred embodiment, the platform has a toe guard at the front end region at which the exerciser's toes are positioned during toning. Advantageously, a pair of handles is provided on opposite sides of the mechanism for gripping by the exerciser's hands to assist the exerciser in maintaining balance during toning. The mechanism preferably includes a scissors-type linkage. An elongated channel is provided in the base, and the linkage has a bottom link that is movable along the channel during the guided movement of the seat guide. The mechanism includes a spring to which the bottom link is operatively connected. The spring is adjustably tensioned to provide resistance during movement from the raised to the lowered position, and to provide a restoring force to return the seat guide from the lowered to the raised position.

Figure 4:
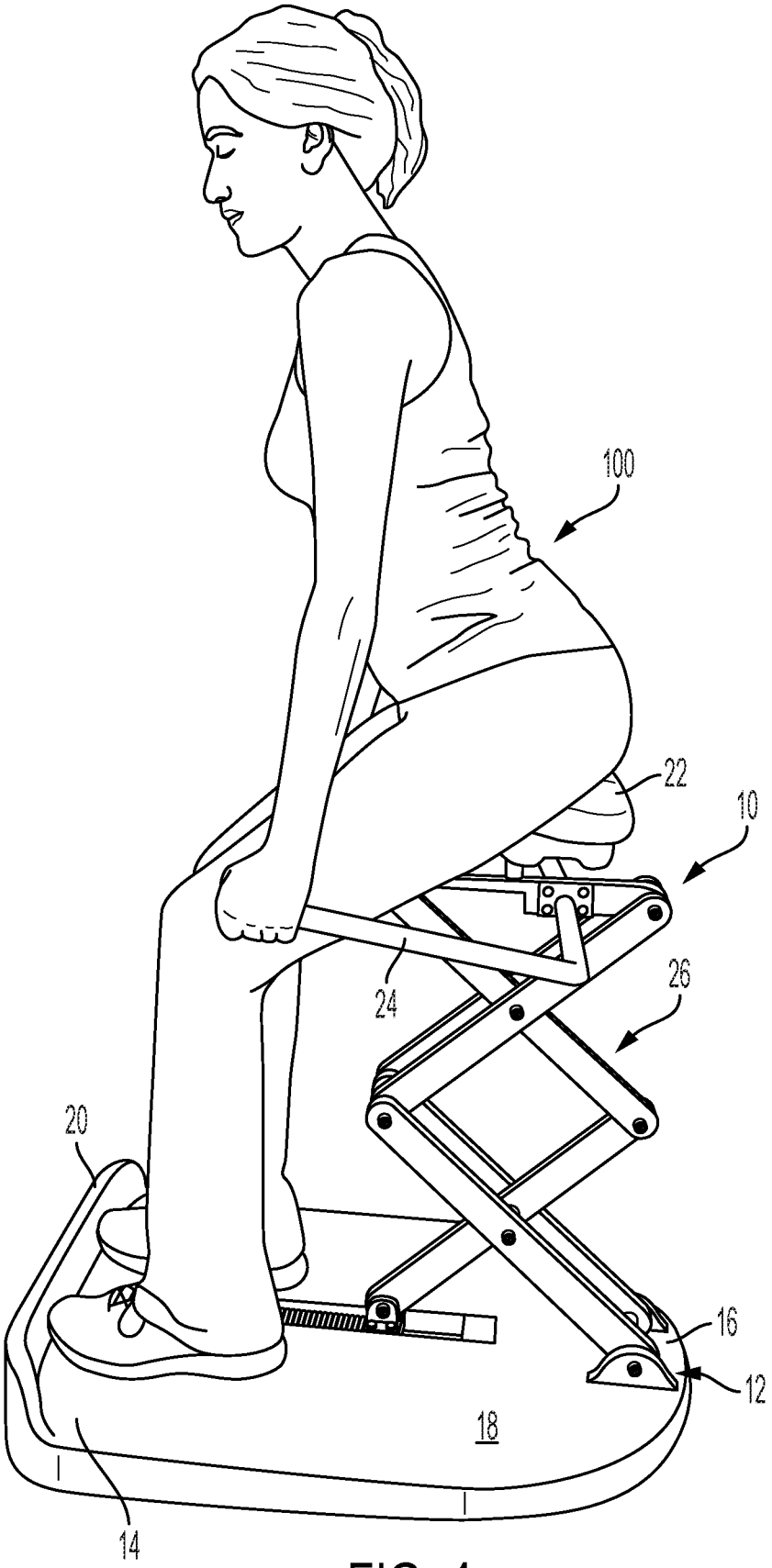
FIG. 4 is a side view of the apparatus of FIG. 1 in use in the raised position.
Figure 5:
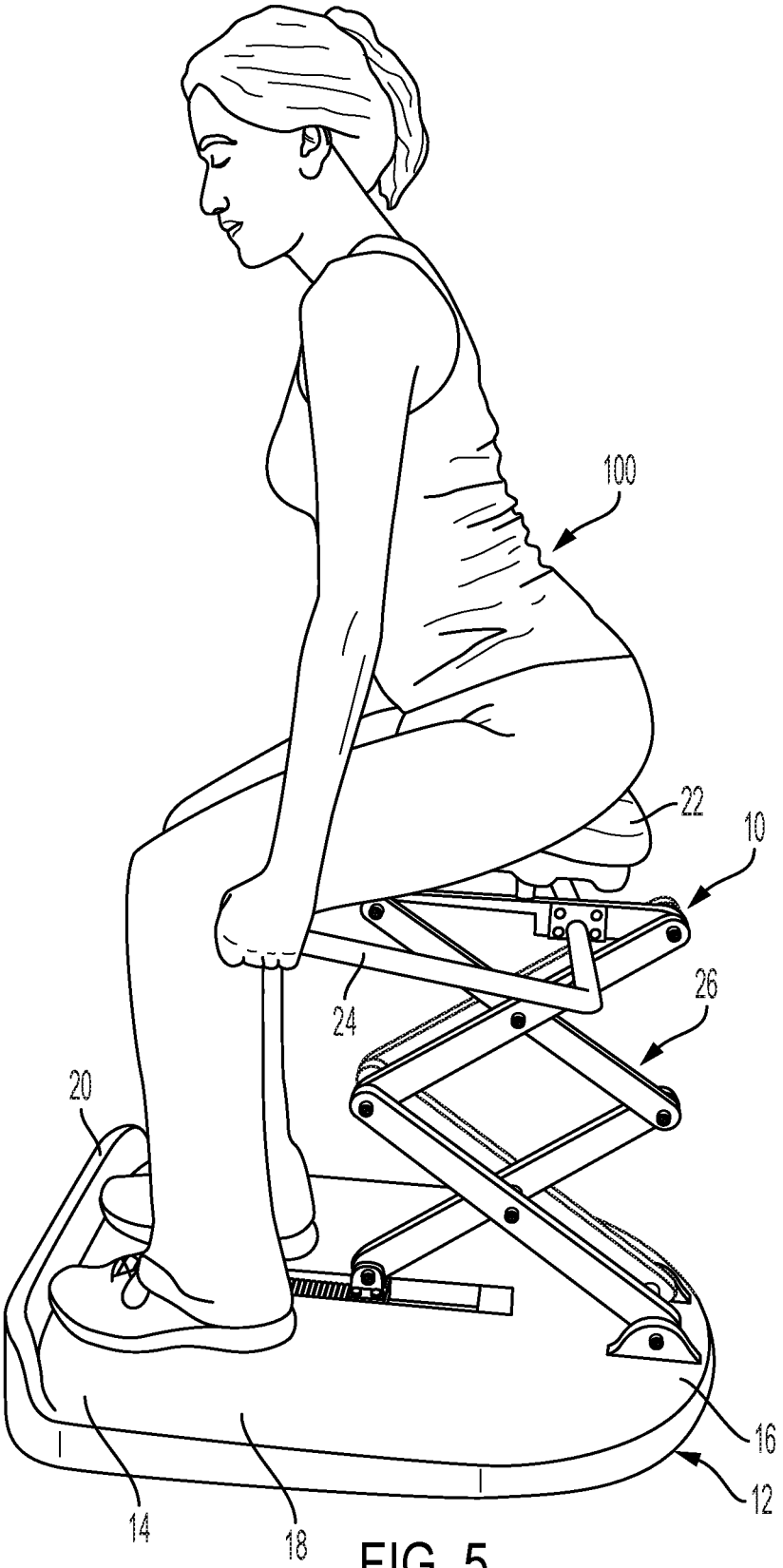
FIG. 5 is a view analogous to FIG. 4 in an intermediate position.
Figure 6:
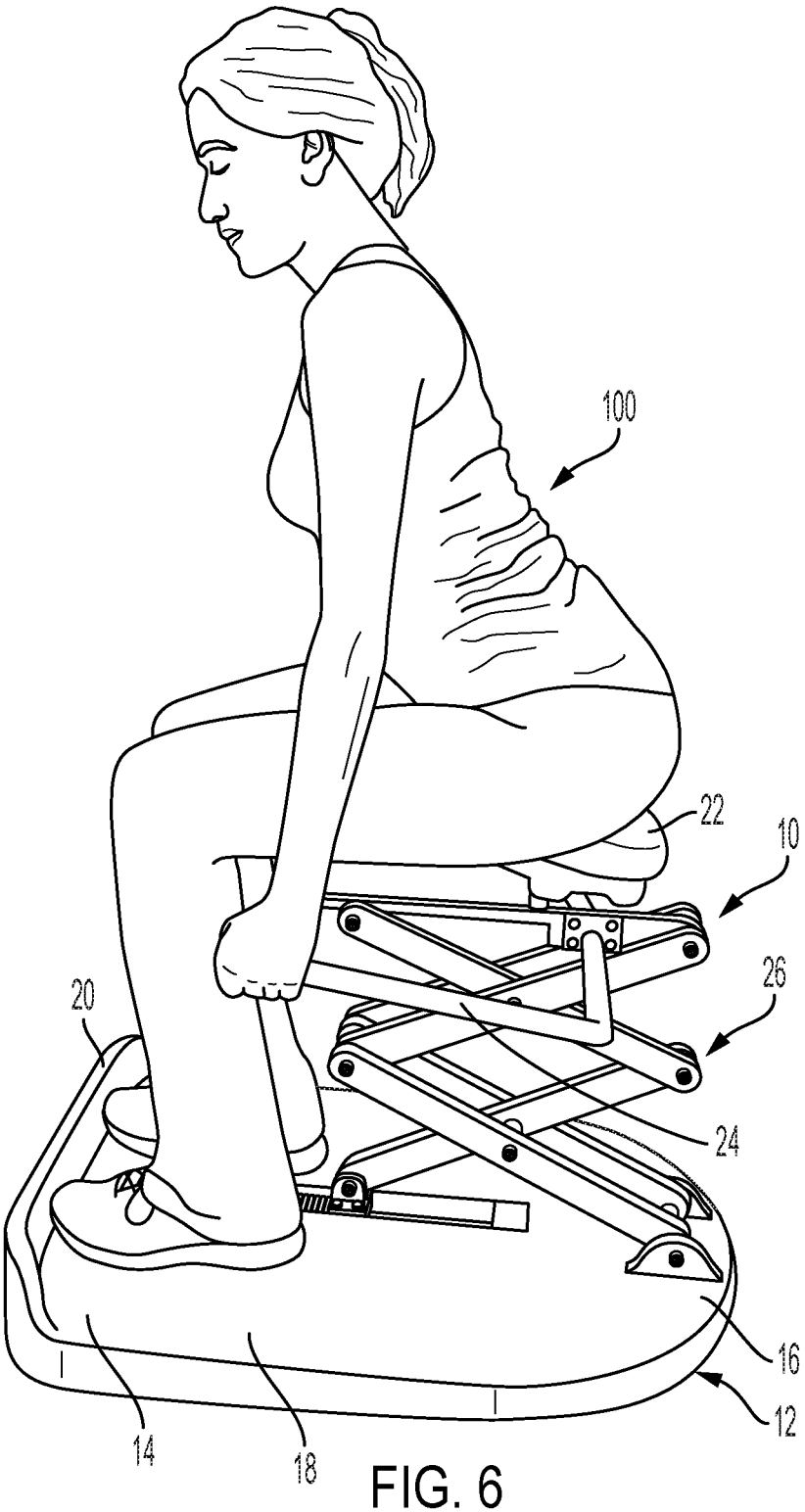
FIG. 6 is a view analogous to FIG. 4 in the lowered position.

With reference to the drawings, reference numeral 10 generally identifies an apparatus for toning and firming an exerciser's buttocks. An exerciser 100 is depicted in FIGS. 4-6, where the operation of the apparatus 10 is shown in sequence.

The apparatus 10 includes a base 12 that rests on the floor, preferably in one's home, or in a gym. The base 12 has a front end region 14, a rear end region 16, and a generally planar platform 18 on which the exerciser 100 stands during toning. Preferably, a weight-shifter, such as raised toe guard 20, is provided at the front end region at which the exerciser's toes are positioned during toning (see FIGS. 4-6). A foot ramp, either open or closed, can also be used. An adjustable seat guide 22, for example, a bench seat or the illustrated bicycle seat, is situated adjacent and below the exerciser's buttocks during toning. A pair of handles 24 is provided on opposite sides of the seat guide 22 for gripping by the exerciser's hands to assist the exerciser 100 in maintaining balance during toning.

The apparatus 10 further includes a force-transmitting mechanism 6 for supporting the seat guide 22 on the base 12 for guided movement under tension from a raised position (FIG. 4) in which the seat guide 22 is situated at a higher elevation above the rear end region 16 of the base 12, along an inclined trajectory in which the seat guide 22 is continuously lowered in elevation and continuously moved toward the front end region 14 of the base 12 by pressure exerted by the exerciser's buttocks, to a lowered position (FIG. 6) in which the seat guide 22 is situated at a lower elevation above the base 12. The force-transmitting mechanism is biased to place the seat guide in the upper position.

The mechanism 26 may include a scissors-type, parallelogram linkage having a bottom link 28. An elongated channel 30 is provided in the base 12. The channel 30 extends between the front 14 and rear 16 end regions. The bottom link 28 is movable along the channel 30 during the guided movement of the seat guide 22. Although not illustrated, the mechanism 26 is preferably encased in a housing as a safety precaution.

Figure 3:
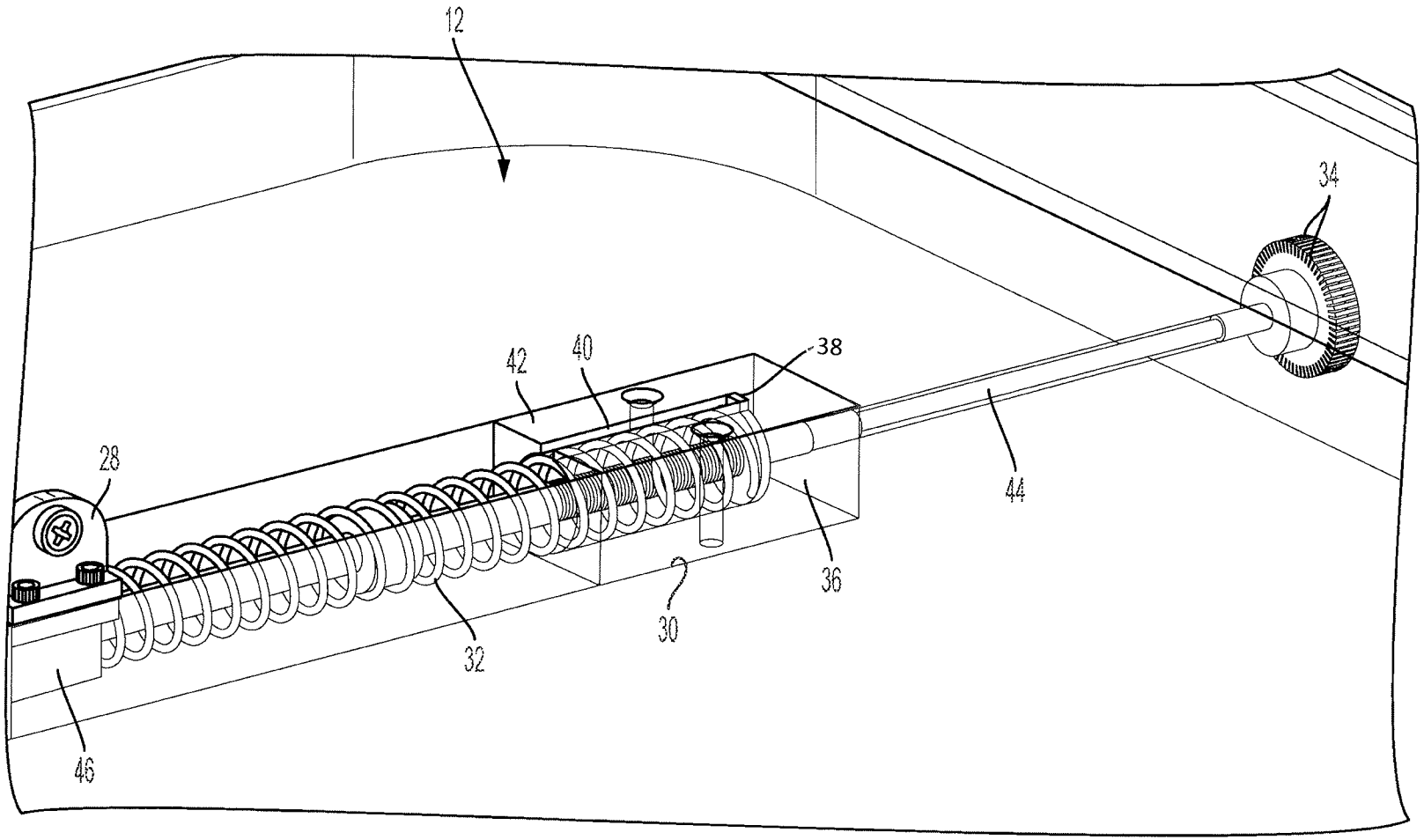
FIG. 3 is an enlarged detail of the apparatus of FIG. 1.

As best shown in FIG. 3, the biasing of the mechanism 26 may be provided by an adjustable tensioning assembly. The assembly may comprise a tensioned, elongated coil spring 32, mounted inside the base 12 within the channel 30. The distal end of the spring is operatively connected to block 46. Bottom link 28 is likewise operatively connected to block 46. Tension adjustment rod 44 with knob 34 has its distal end journaled in block 36. The rod is threaded along a portion of its length.

The other end of the spring rests against threaded washer 36, which mates with and is constrained to move along the threaded portion of rod 44. The washer has a tab 38 that rides along slot 40 in guide box 42 in base 12, allowing the washer to travel along the rod in response to turning of the adjustment rod. Accordingly, turning a knob 34 in one circumferential direction drives the washer towards the block 46, tensioning the spring 32. Turning the knob 34 in the opposite circumferential direction backs the washer away from the block 46, releasing the tension in the spring 32. The spring 32 provides an adjustable resistance during movement from the raised to the lowered position, and also provides a restoring force to return the seat guide 22 from the lowered to the raised position.

In use, as shown in FIG. 4, the exerciser 100 stands on the platform 18 with her toes against the toe guard 20. The exerciser's feet are hip distance apart. The exerciser's shoulders are back. The exerciser's buttocks are placed against the seat guide 22. The exerciser's hands grip the handles 24. The exerciser's core and glutes are engaged. The weight-shifting toe guard or ramp is slanted upwardly toward the front of the unit to place the exerciser's center of gravity slightly off center, with most of the exerciser's weight on her heels, allowing the glutes to be properly engaged. However, the unit can be operated without the toe guard or ramp.

The exerciser 100 tensions her glutes and presses with her buttocks against the seat guide 22 against the force of the tensioned spring 32. In a controlled movement the exerciser 100 applies her mass against the seat guide. As shown in the intermediate position of FIG. 5, the linkage 26 begins to collapse. The exerciser continues to allow the seat guide to slowly and gradually lower in elevation and move toward the front end region 14 of the base 12. The bottom link 28 has moved forwardly in the channel 30. As shown in the lowered position of FIG. 6, the linkage 26 has further collapsed. The seat guide 22 has gradually further lowered in elevation and has gradually further moved toward the front end region 14 of the base 12. The bottom link 28 has moved further forwardly in the channel 30. Thus, the seat guide 22 has been moved along the aforementioned inclined trajectory, targeting and exercising the gluteal muscles and, over time and repeated use, tones, firms, tightens and sculpts the buttocks. With the seat guide in the lowered position, the exerciser 100 slowly releases the pressure exerted by her buttocks against the seat guide 22, allowing the tensioned spring 32 to slowly return the seat guide 22 to the raised position in a further controlled motion, further exercising the exerciser's glutes.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative e than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

The invention claimed is:

1. An apparatus for toning an exerciser's buttocks, comprising:

a base having a front end region and a rear end region, whereby, during use, the exerciser's feet exert a force on a weight-shifter located at the front end region; a platform;

a seat guide; and a force-transmitting mechanism for supporting the seat guide on the base for guided movement under tension from a raised position in which the seat guide is situated at a higher elevation above the rear end region of the base, along an inclined trajectory in which the seat guide is continuously lowered in elevation and continuously moved toward the front end region of the base, to a lowered position in which the seat guide is situated at a lower elevation above the base wherein the base has an elongated channel extending between the front and rear end regions;

and said force-transmitting mechanism includes a scissor linkage, wherein the scissor linkage has a bottom link, wherein a first end of the bottom link is movable along the channel during the guided movement of the seat guide, the first end of the bottom link being moved toward the front end region and a second end of the bottom link being moved toward the platform when the seat guide is moved from the raise positioned to the lowered position.

2. The apparatus of claim 1, wherein the force-transmitting mechanism is adjustable.

3. The apparatus of claim 1, further comprising a pair of handles on opposite sides of the force-transmitting mechanism for gripping by the exerciser's hands to assist the exerciser in maintaining balance during toning.

4. The apparatus of claim 1, wherein the force-transmitting mechanism includes a spring to which the bottom link is operatively connected.

5. The apparatus of claim 4, further comprising an adjustable tensioning assembly.

6. The apparatus of claim 5, wherein the adjustable tensioning assembly comprises a threaded rod, a washer threaded on the rod for travel along the rod bearing against one end of the spring, and a knob for rotating the rod such that the washer travels along the rod to vary the compression of the spring.

7. The apparatus of claim 5, wherein the scissor linkage is a parallelogram linkage.

8. An apparatus for toning an exerciser's buttocks, comprising:

a base having a front end region and a rear end region, whereby, during use, the exerciser's feet exert a force on a weight-shifter located at the front end region, wherein the base has a platform on which the exerciser stands during toning;

a seat guide adjacent and above which the exerciser's buttocks are positioned during toning;

a pair of handles on opposite sides of the seat guide for gripping by the exerciser's hands to assist the exerciser in maintaining balance during toning; and a force-transmitting mechanism for supporting the seat guide on the base for guided movement under tension from a raised position in which the seat guide is situated at a higher elevation above the rear end region of the base along an inclined trajectory in which the seat guide is continuously lowered in elevation and continuously moved toward the front end region of the base by pressure exerted by the exerciser's buttocks, to a lowered position in which the seat guide is situated at a lower elevation above the base, wherein the force-transmitting mechanism includes a scissor linkage and a tensions spring for restoring the seat guide to the raised position upon release of the pressure exerted by the exerciser's buttocks.

* * * * *